US011261637B2

(12) United States Patent
Bacchetti

(10) Patent No.: US 11,261,637 B2
(45) Date of Patent: Mar. 1, 2022

(54) HINGE FOR THE ROTATABLE MOVEMENT OF A DOOR, A SHUTTER OR THE LIKE

(71) Applicant: IN & TEC S.R.L., Brescia (IT)

(72) Inventor: Luciano Bacchetti, Nave (IT)

( * ) Notice: Subject to any disclaimer, the term of this patent is extended or adjusted under 35 U.S.C. 154(b) by 102 days.

(21) Appl. No.: 16/467,970

(22) PCT Filed: Dec. 15, 2017

(86) PCT No.: PCT/IB2017/057988
§ 371 (c)(1),
(2) Date: Jun. 9, 2019

(87) PCT Pub. No.: WO2018/109732
PCT Pub. Date: Jun. 21, 2018

(65) Prior Publication Data

US 2020/0115943 A1 Apr. 16, 2020

(30) Foreign Application Priority Data

Dec. 15, 2016 (IT) ..... 102016000126563
Dec. 15, 2016 (IT) ..... 102016000126588
(Continued)

(51) Int. Cl.
*E05F 3/10* (2006.01)
*E05F 1/12* (2006.01)
(Continued)

(52) U.S. Cl.
CPC ..... *E05F 3/104* (2013.01); *E05F 1/1253* (2013.01); *E05F 3/16* (2013.01); *E05F 3/20* (2013.01);
(Continued)

(58) Field of Classification Search
CPC ..... E05F 1/1041; E05F 1/105; E05F 1/1058; E05F 1/12; E05F 1/1246; E05F 1/1253;
(Continued)

(56) References Cited

U.S. PATENT DOCUMENTS 1,666,903 A * 4/1928 Henrye ..... E05F 3/104 16/55
2,035,823 A * 3/1936 Moore ..... E05D 11/1064 16/284
(Continued)

FOREIGN PATENT DOCUMENTS

DE 2456489 A1 * 8/1976 ..... E05F 1/1253
DE 102013219037 B3 * 9/2014 ..... E05F 3/10
(Continued)

*Primary Examiner* — Emily M Morgan
(74) *Attorney, Agent, or Firm* — Themis Law

(57) ABSTRACT

A hinge for the rotatable movement of a closing element, such as a door, a window, a shutter or the like, includes a fixed element anchorable to a stationary support structure and a mobile element anchorable to the closing element. The fixed and movable elements are mutually coupled so as to rotate with respect to each other between an open position and a closed position. One of the fixed or movable element includes a working chamber, with a plunger disposed to slide along a longitudinal axis and operatively coupled with the other one of the fixed or movable elements so that the sliding of the plunger corresponds to a rotation of the movable element.

9 Claims, 10 Drawing Sheets

(30) Foreign Application Priority Data

Dec. 15, 2016 (IT) ..... 102016000126612
Dec. 15, 2016 (IT) ..... 102016000126630
Dec. 15, 2016 (IT) ..... 102016000126661

(51) Int. Cl.
*E05F 3/16* (2006.01)
*E05F 3/20* (2006.01)

(52) U.S. Cl.
CPC ... *E05Y 2201/638* (2013.01); *E05Y 2900/132* (2013.01)

(58) Field of Classification Search
CPC ..... E05F 5/02; E05F 5/10; E05F 3/16; E05F 3/20; E05F 3/104; E05F 3/10; E05F 3/12; E05Y 2201/638; E05Y 2900/132
See application file for complete search history.

(56) References Cited

U.S. PATENT DOCUMENTS 2,588,010 A * 3/1952 Kennon ..... E05F 3/104 16/239
3,137,888 A * 6/1964 Blom ..... E05F 3/104 16/51
4,000,540 A * 1/1977 Newlon ..... E05F 1/1253 16/298
5,901,412 A * 5/1999 Jentsch ..... E05F 3/104 16/53
9,353,565 B2 * 5/2016 Bacchetti ..... E05F 3/20
2010/0024159 A1 * 2/2010 Oh ..... E05D 5/0246 16/54
2011/0219583 A1 * 9/2011 Bacchetti ..... E05F 1/1253 16/54
2012/0210540 A1 * 8/2012 McKibben ..... E05F 1/10 16/64
2014/0053369 A1 * 2/2014 Miglioranzo ..... E05F 3/12 16/54
2014/0075718 A1 * 3/2014 Bacchetti ..... E05F 3/20 16/54
2016/0160550 A1 * 6/2016 Bacchetti ..... E05D 11/1028 16/319
2016/0168897 A1 * 6/2016 Miglioranzo ..... E05F 3/104 16/50
2017/0030124 A1 * 2/2017 Bacchetti ..... E05F 3/20
2017/0030125 A1 * 2/2017 Bacchetti ..... E05F 3/10

FOREIGN PATENT DOCUMENTS

DE 202015006151 U1 * 12/2016 ..... E05F 3/104
EP 0409485 A1 * 1/1991 ..... E05F 3/104
EP 3556980 A1 * 10/2019 ..... E05F 1/1261
FR 821378 A * 12/1937 ..... E05F 1/1253
WO WO-2015060519 A1 * 4/2015 ..... E05F 3/104
WO 2015111027 7/2015
WO WO-2017077491 A * 5/2017 ..... E05F 3/104
WO WO-2020079496 A1 * 4/2020 ..... E05F 3/12

* cited by examiner

HINGE FOR THE ROTATABLE MOVEMENT OF A DOOR, A SHUTTER OR THE LIKE

FIELD OF THE INVENTION

The present invention generally regards the technical field of hinges for doors, shutters or the like, and it particularly regards a hinge for the rotatable movement of a closing element, such as a door, a window, a shutter or the like.

STATE OF THE ART

As known, hinges generally comprise a movable element, usually fixed to a door, a shutter or the like, hinged on a fixed element, usually fixed to the support frame of the latter.

In particular, the hinges usually used in cold stores or in the glass shutters are cumbersome, aesthetically wanting and poorly functional.

Documents U.S. Pat. No. 7,305,797, US2004/206007 and EP1997994 reveal hinges in which the action of the of the closing means, which guarantee the return of the shutter to the closed position, is not countered. Thus, there is the risk of the shutter strongly abutting against the support frame, ending up damaged.

Documents EP0407150 and FR2320409 reveal door closers including hydraulic damping means for countering the action of the closing means. Such known devices have extremely large overall dimension and, thus, they have to be floor-mounted.

Thus, the installation of such devices necessarily requires costly and complicated ground breaking works, which must be performed by specialised personnel.

It is thus clear that such door closer is not suitable for assembly in the stationary support structure or in the shutter of cold stores.

The German patent DE3641214 reveals an automatic closing device for window shutters suitable to be mounted externally with respect thereto.

SUMMARY OF THE INVENTION

An object of the present invention is to at least partly overcome the aforementioned drawbacks, by providing a hinge that is highly functional, easy to manufacture and inexpensive.

Another object of the invention is to provide a hinge that requires minimum maintenance.

Another object of the invention is to provide a hinge with small overall dimensions.

Another object of the invention is to provide a hinge that can be interposed between the shutter and the stationary support structure of a cold store.

Another object of the invention is to provide a hinge capable of guaranteeing the automatic closure of the door from the door open position.

Another object of the invention is to provide a hinge capable of guaranteeing the controlled movement of the door to which it is constrained, both during the opening and closure.

Another object of the invention is to provide a hinge that is capable of supporting even very heavy doors, frames, without varying the behaviour and without requiring adjustments.

Another object of the invention is to provide a hinge that has a minimum number of components.

Another object of the invention is to provide a hinge capable of maintaining the exact closing position over time.

Another object of the invention is to provide a hinge that is extremely easy to install.

These and other objects that will be more apparent hereinafter, are attained by a hinge according to what is described, illustrated and/or claimed herein.

In a first aspect, there may be provided a hinge for the rotatable movement of a closing element, such as a door, a window, a shutter or the like, between at least one closing position and at least one opening position, the closing element being anchorable to a stationary support structure, such as a wall, a floor, a frame or the like, the hinge comprising:

- a fixed element anchorable to the stationary support structure;
- a movable element anchorable to the closing element, the fixed and movable elements being mutually coupled so that the latter rotates—with respect to the former—around a first longitudinal axis;

wherein one of the fixed element and movable element includes at least one working chamber defining a second longitudinal axis, the at least one working chamber including at least one plunger element slidable along the second axis, the at least one plunger element being operatively coupled with the other of the fixed element and movable element so that the sliding of the former corresponds to the rotation of the movable element;

wherein the at least one working chamber further includes braking means mutually interacting by friction with the at least one plunger element to brake the rotatable movement of the closing element, the braking means and/or the at least one plunger element being mutually configured to provide a differentiated friction during the sliding of the latter along said second axis, so that the closing element is correspondingly braked with differentiated force.

In a further aspect, irrespective of the above, there may be provided a hinge for the rotatable movement of a closing element, such as a door, a window, a shutter or the like, between at least one closing position and at least one opening position, the closing element being anchorable to a stationary support structure, such as a wall, a floor, a frame or the like, the hinge comprising:

- a fixed element anchorable to the stationary support structure;
- a movable element anchorable to the closing element, the fixed element and the movable elements being mutually coupled so that the latter rotates—with respect to the former—around a first longitudinal axis;

wherein one of the fixed element and movable element includes at least one working chamber defining a second longitudinal axis, the at least one working chamber including at least one plunger element slidable along the second axis between a first end-stroke position, corresponding to one of the at least one closing position and the at least one opening position, and a second end-stroke position, corresponding to the other of the at least one closing position and the at least one opening position, the at least one plunger element being operatively coupled with the other of the fixed element and movable element so that the sliding of the former corresponds to the rotation of the movable element;

wherein the at least one working chamber includes at least one stop element susceptible to interact with the at least one plunger element to lock the sliding thereof at said first and/or said second end-stroke position, so as to correspondingly lock the rotation of the closing element at the at least one closing position and at least one opening position.

In a further aspect, irrespective of the above, there may be provided a hinge for the controlled rotatable movement of at least one closing element, such as a door, a shutter or the like, anchored to a stationary support structure, such as a wall, a floor, a frame or the like, the hinge comprising:

a hinge body anchorable to one of the stationary support structure and the at least one closing element and at least one pin defining a first axis anchorable to the other of the stationary support structure and the closing element, the at least one pin and the hinge body being mutually coupled so that said closing element rotates between at least one open position and at least one closed position;

at least one working chamber within said hinge body defining a second axis substantially perpendicular to the first axis, the at least one working chamber including a bottom wall;

at least one plunger element slidable in said at least one working chamber along the second axis between a position proximal to the bottom wall of the at least one working chamber and a position distal therefrom;

wherein the at least one pin includes cam means rotating around the first axis to displace the at least one plunger element from the distal position to the proximal position, there being further provided cam follower means interacting with said cam means integrally coupled with the at least one plunger element to slide therewith along said second axis, said at least one pin being inserted into a substantially cylindrical seat passing through the hinge body having an axis coincident with said first axis;

wherein the at least one pin further includes braking means mutually interacting by friction with said hinge body to brake the rotatable movement of the closing element between the at least one open position and the at least one closed position.

In a further aspect, irrespective of the above, there may be provided a system for the rotatable movement of a closing element anchorable to a stationary support structure, comprising:

at least one hinge comprising a substantially box-shaped hinge body anchorable to the stationary support structure and a pin, the latter and the hinge body being mutually coupled to rotate around a first axis between at least one open position and at least one closed position, the pin including a coupling portion protruding from the hinge body having at least one first shaped zone;

at least one coupling device comprising at least one first plate-shaped element and at least one second longitudinal plate-shaped element anchorable to the closing element, the at least one first plate-shaped element and at least one second longitudinal plate-shaped element being mutually superimposed and coupled, the at least one first plate-shaped element including a first counter-shaped seat mutually coupled with the at least one first shaped zone of the coupling portion of the pin;

wherein said at least one second longitudinal plate-shaped element is rotationally supported by the at least one first plate-shaped element, the at least one coupling device further including at least one connection element between the at least one first plate-shaped element and at least one second longitudinal plate-shaped element to allow the integral rotation thereof, the at least one connection element being configured to break upon exceeding a predetermined load threshold so as to allow the free mutual rotation between said at least one first plate-shaped element and at least one second longitudinal plate-shaped element, so that both the latter and the hinge remain intact in case of inadvertent impact against the closing element.

In a further aspect, irrespective of the above, there may be provided a system for the rotatable movement of a closing element anchorable to a stationary support structure susceptible to close against an abutment surface, comprising:

at least one hinge comprising a substantially box shaped hinge body anchorable to the stationary support structure and a pin, the latter and the hinge body being mutually coupled to rotate around a first axis between a closed position and at least two open positions opposite with respect to the closed position, the pin including a coupling portion protruding from the hinge body;

at least one coupling device comprising at least one first plate-shaped element and at least one second longitudinal plate-shaped element anchorable to the closing element mutually coupled to each other, said at least one second longitudinal plate-shaped element defining a second axis substantially perpendicular to the first axis, the at least one first plate-shaped element including a first counter-shaped seat mutually couplable with the coupling portion of the pin;

wherein said first counter-shaped seat has an elongated shape defining a third axis substantially perpendicular to the first axis and angularly spaced apart with respect to the second axis, the coupling portion of the pin defining a fourth axis coincident with said third axis so that in the at least one closed position the coupling device pushes the closing element against the relative abutment surface;

wherein said first counter-shaped seat passes through the at least one first plate-shaped element, the latter and the at least one second longitudinal plate-shaped element being coupled in a removable manner so as to allow a user or operator to overturn the at least one first plate-shaped element around the second axis to select the inclination direction of the third axis with respect to the latter, so as to use the coupling device on a closing element with right or left opening indistinguishably.

Advantageous embodiments of the invention are defined according to the dependent claims.

BRIEF DESCRIPTION OF THE DRAWINGS

Further characteristics and advantages of the invention will be more apparent in light of the detailed description of a preferred but non-exclusive embodiment of a hinge 1, illustrated by way of non-limiting example with reference to the attached drawings, wherein.

DETAILED DESCRIPTION OF SOME PREFERRED EMBODIMENTS

With reference to the aforementioned figures, the hinge according to the invention, indicated in its entirety with reference number 1, will be advantageously applicable for cold stores or for glass shutters, such as for example those of a display window or display case. The shutter D may close against an abutment surface, for example the gasket of a cold store or the frame of a display case.

Figure 1:
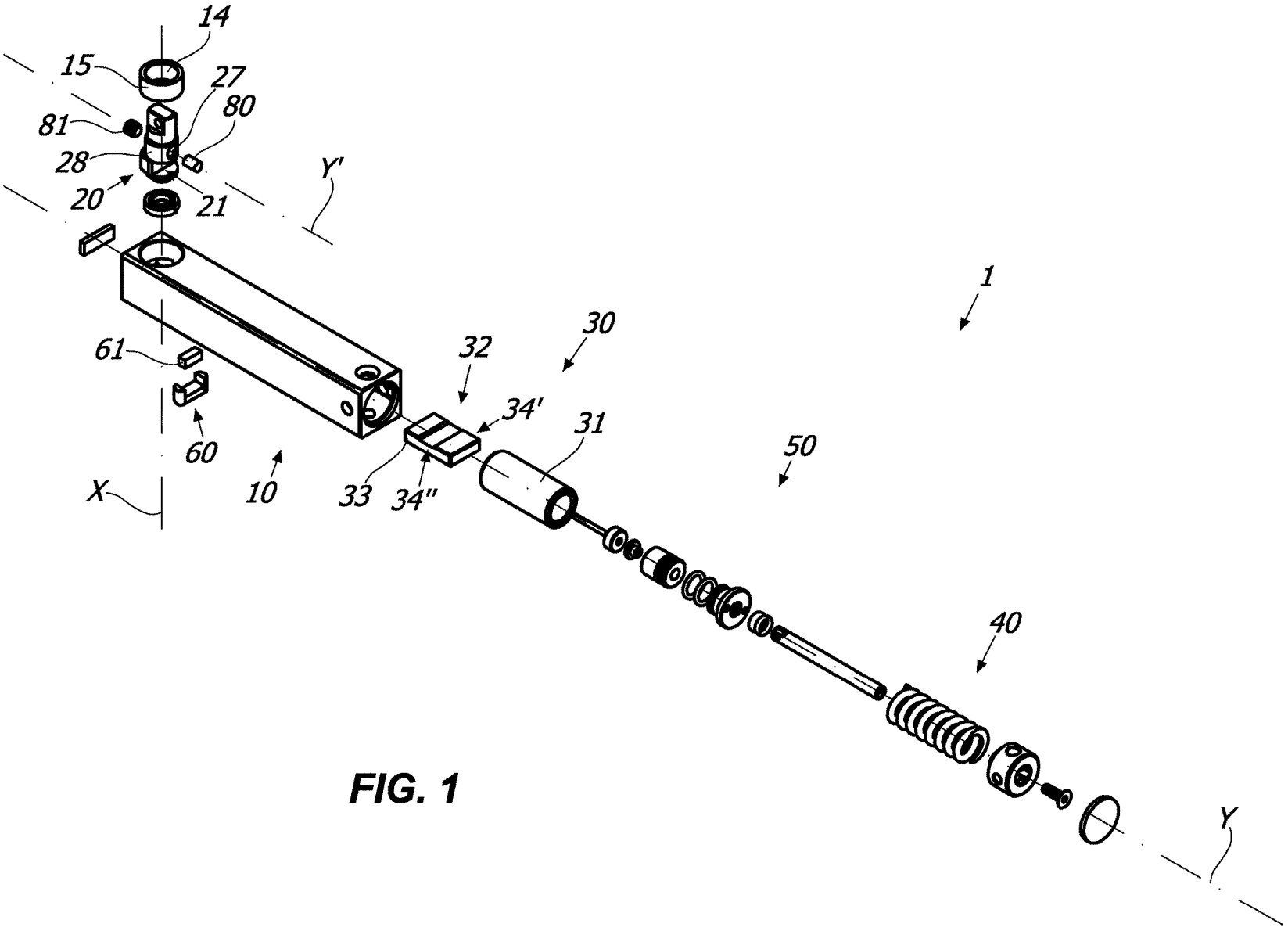
FIG. 1 is an exploded axonometric view of a first embodiment of the hinge 1.
Figure 2A:
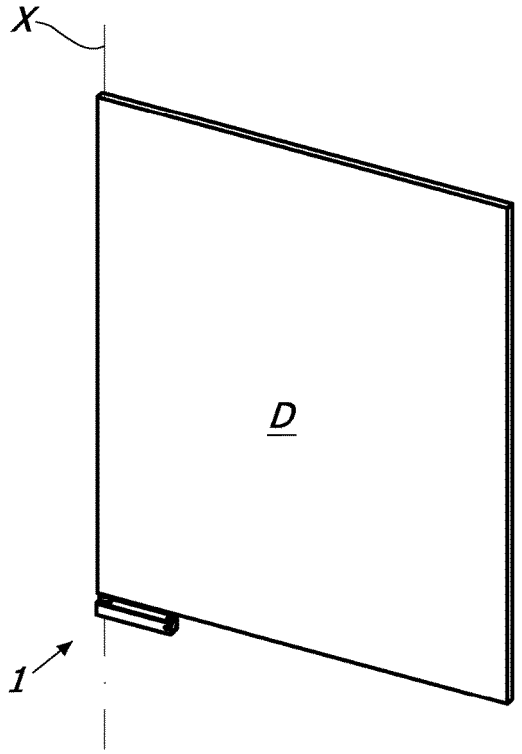
FIGS. 2A and 2B are respectively shown in axonometric view mounted on a shutter D and in an enlarged cross-section of the first embodiment of the hinge 1 of FIG. 1 in the door-closed position D.
Figure 4A:
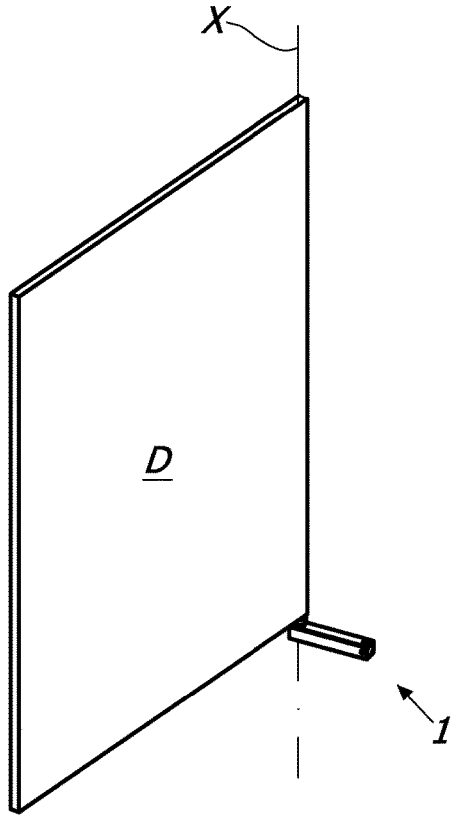
FIGS. 4A and 4B are respectively shown in axonometric view mounted on a shutter D and in an enlarged cross-section of the first embodiment of the hinge 1 of FIG. 1 in the door-fully-open position D.
Figure 6A:
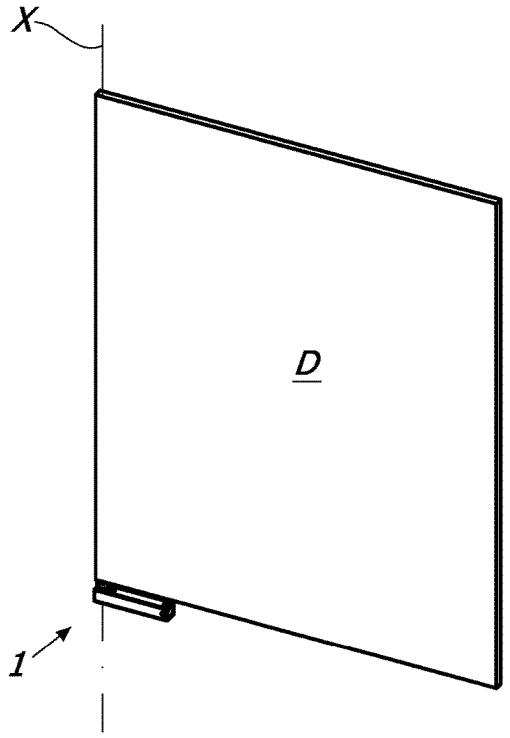
FIGS. 6A and 6B are respectively shown in axonometric view mounted on a shutter D and in an enlarged cross-section of the second embodiment of the hinge 1 of FIG. 5 in the door-closed position D.
Figure 6B:
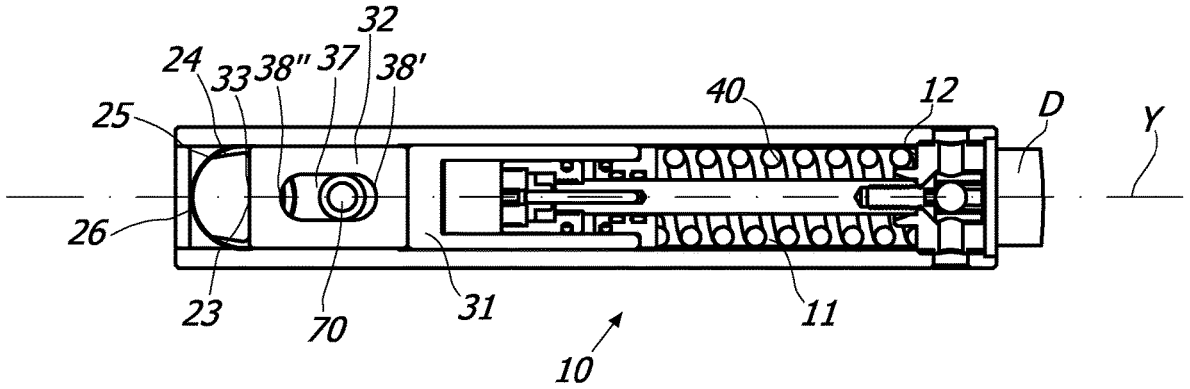
Figure 7A:
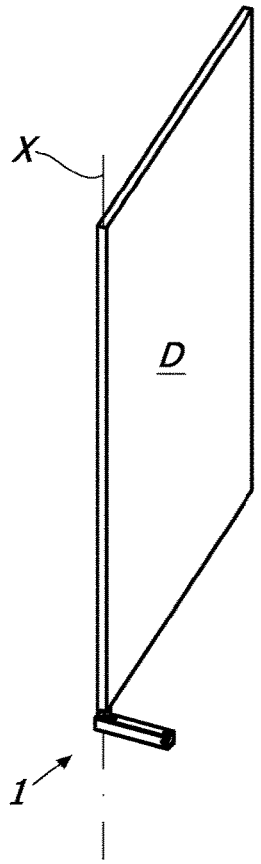
FIGS. 7A and 7B are respectively shown in axonometric view mounted on a shutter D and in an enlarged cross-section of the second embodiment of the hinge 1 of FIG. 5 in the door-open position D.

The hinge 1 is generally suitable to rotatably couple a stationary support structure, for example a tubular frame S, and a closing element, for example a shutter D, rotatably movable between an opening position, illustrated for example in FIGS. 2*a* and 6*b*, and a closing position, illustrated for example in FIGS. 4A and 7A, around a rotation axis X.

It should be observed that even though hereinafter reference shall be made to the frame S and the shutter D, the hinge 1 is applicable to any stationary support structure and any closing element without departing from the scope of protection of the attached claims.

The hinge 1 shall suitably include a substantially box-shaped hinge body 10 and a pin 20 defining the rotation axis X.

In a preferred but non-exclusive embodiment, the hinge body 10 may be anchored to the frame S, while the pin 20 may be anchored to the shutter D. In this case, the fixed element will include the hinge body 10, while the mobile element may include the pin 20.

Vice versa, in an embodiment of the invention not illustrated in the attached drawings, the hinge body 10 may be anchored to the shutter D and the pin 20 to the frame S, without departing from the scope of protection of the attached claims. In this case, the fixed element will include a pin 20, while the mobile element may include the hinge body 10.

Furthermore, it will be clear that the hinge 1 must not necessarily include a pin 20, given that the presence of an operative connection between the fixed and mobile elements is sufficient.

Advantageously, the hinge body 10 and the pin 20 may be mutually coupled to rotate around the axis X between the shutter open and closed positions D.

More in particular, the pin 20 may be inserted into a substantially cylindrical seat 14 passing through the hinge body 10 having an axis coincident with the axis X.

In a preferred but non-exclusive embodiment, the pin 20 may be configured to rotate around the axis X between a closed position and at least two open positions opposite with respect to the closed position. In other words, the hinge 1 may be ambidextrous, i.e. it can be used on doors or shutters opening to the right and on doors or shutters opening to the left.

The pin 20 may suitably include a cam element 21 integrally joined thereto using a plunger element 30 slidable along an axis Y.

The sliding axis Y of the plunger element 30 may be substantially perpendicular to the axis X. Furthermore, the rotation axis X of the shutter D may be substantially vertical.

Figure 2B:
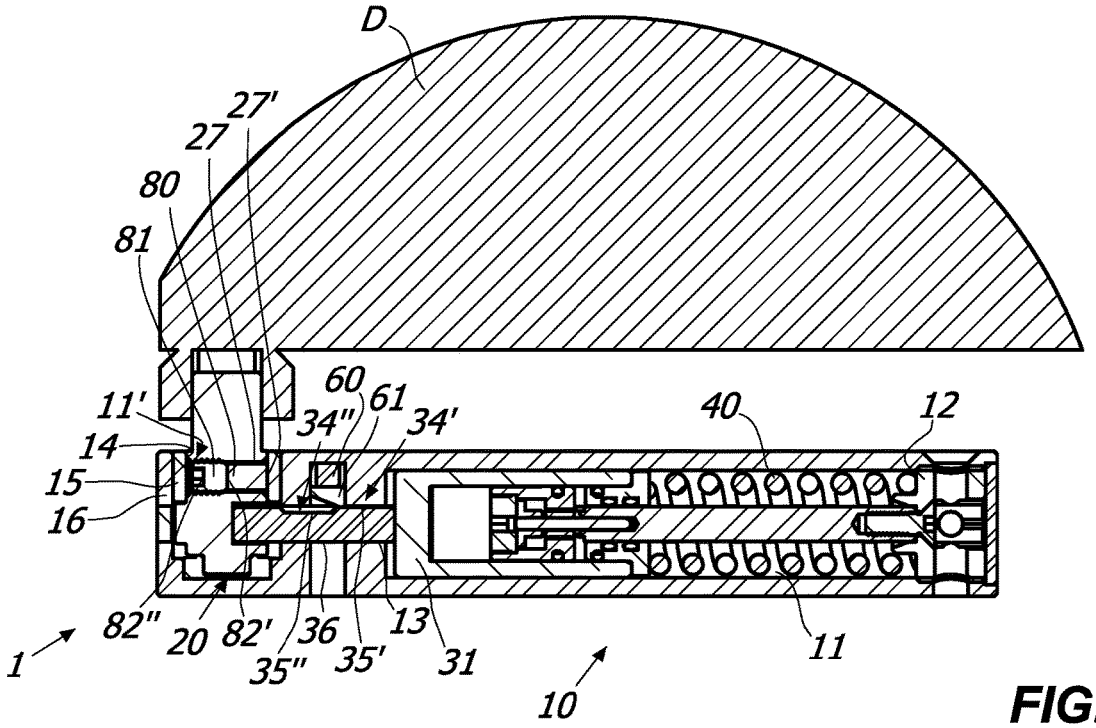
Figure 3A:
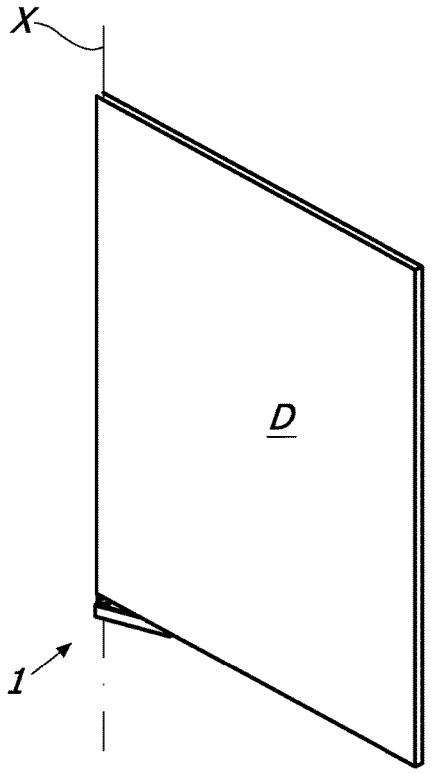
FIGS. 3A and 3B are respectively shown in axonometric view mounted on a shutter D and in an enlarged cross-section of the first embodiment of the hinge 1 of FIG. 1 in the door-partly-open position D.
Figure 3B:
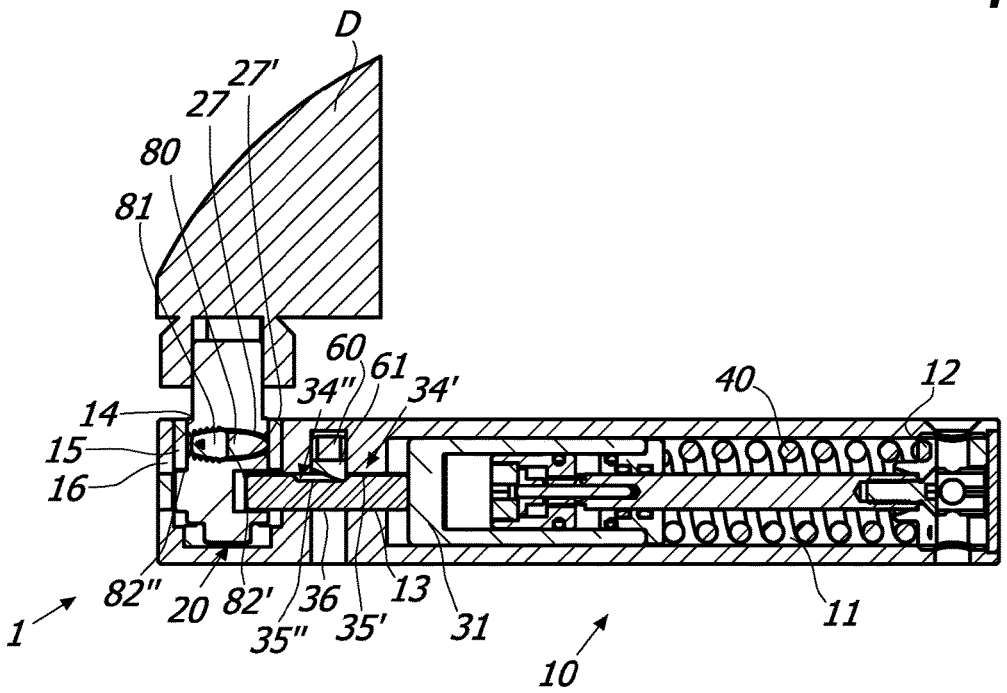
Figure 4B:
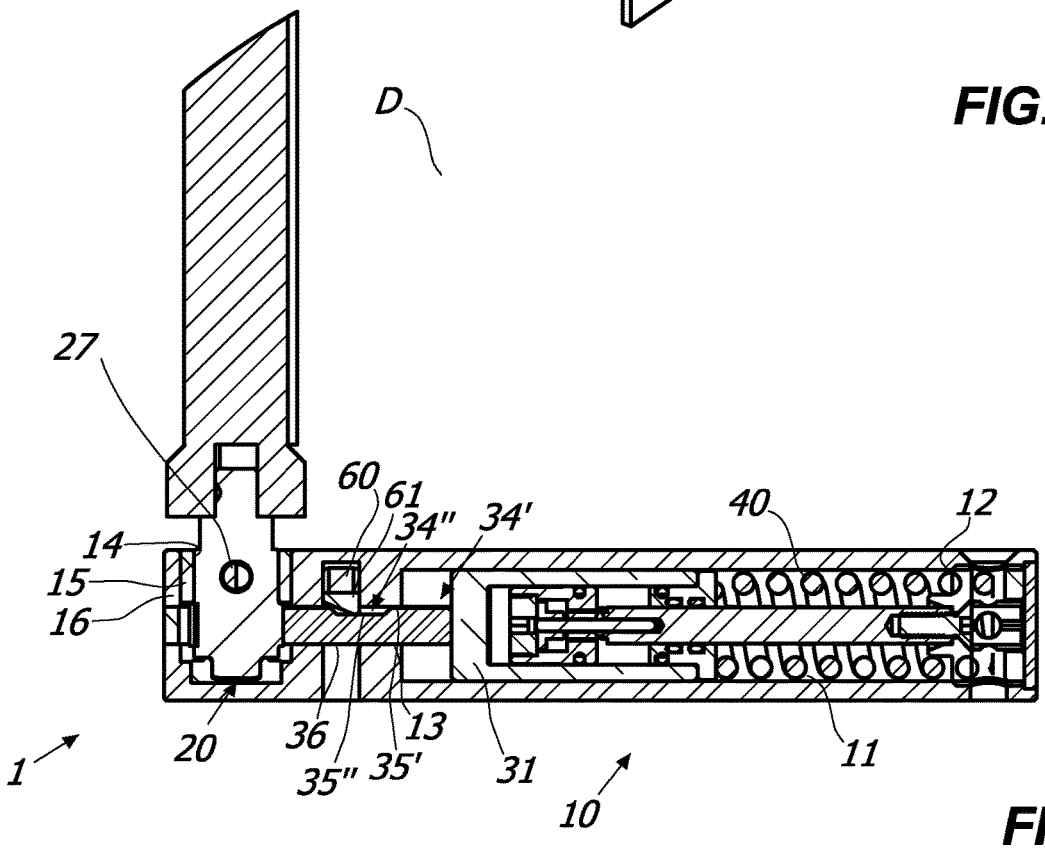
Figure 5:
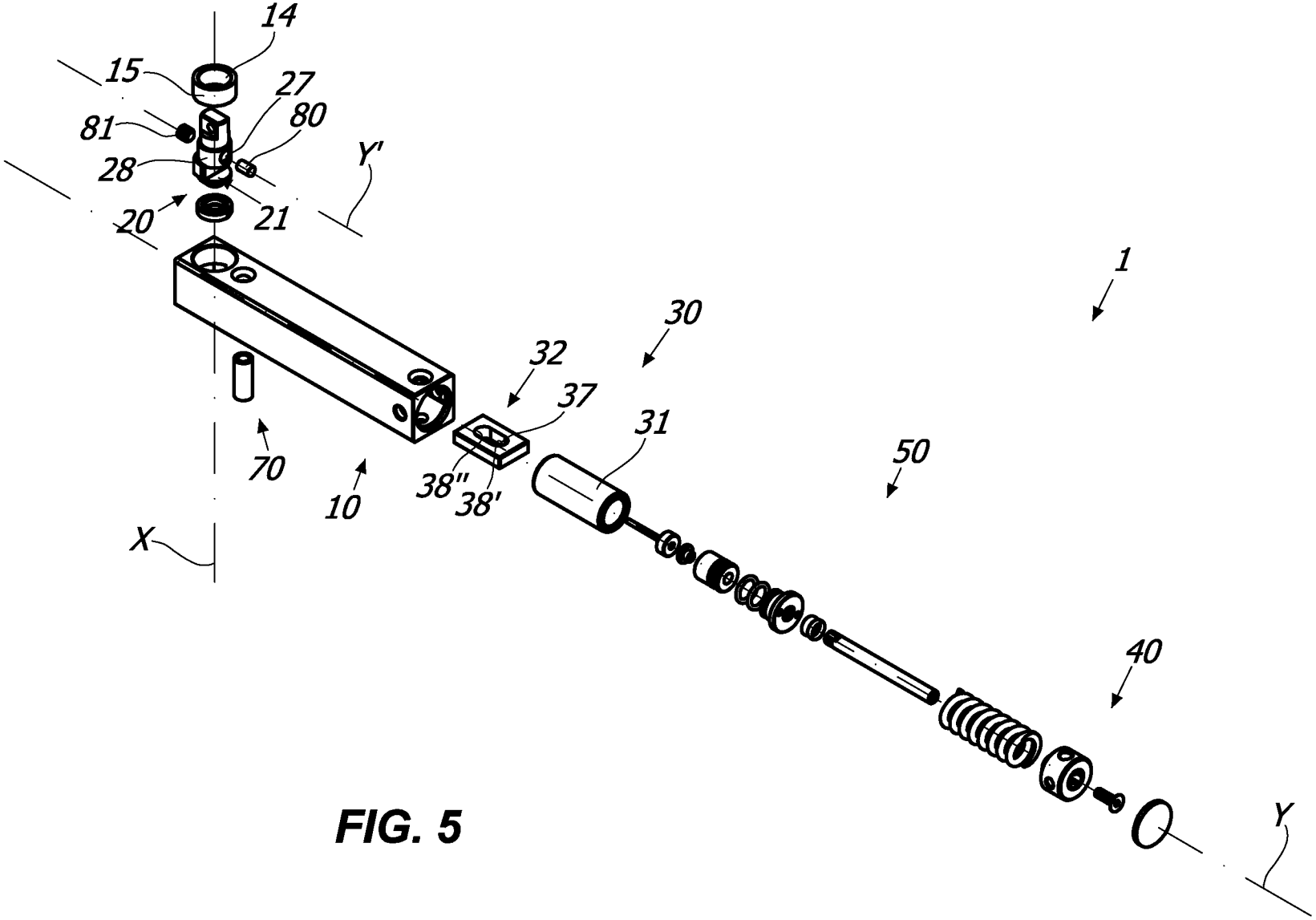
FIG. 5 is an exploded axonometric view of a second embodiment of the hinge 1.
Figure 7B:
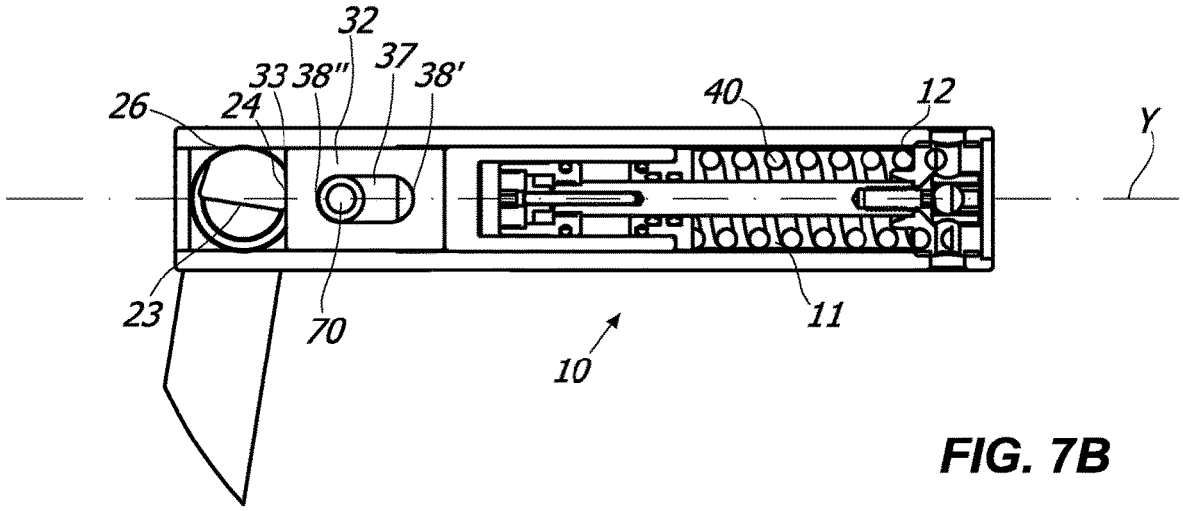

In any case, the plunger element 30, which may include a cylinder 31, may slide in a working chamber 11 within the hinge body 10 between a retracted end-stroke position proximal to the bottom wall 12 of the working chamber 11, for example illustrated in FIGS. 4B and 7B, and an extended end-stroke position distal therefrom, for example illustrated in FIGS. 2B and 6B.

Such retracted and extended end-stroke positions may suitably vary, and not necessarily corresponding to the maximum distal and/or proximal position that can be taken by the plunger element 30.

In a preferred but non-exclusive embodiment of the invention, the working chamber 11 may include elastic counteracting means acting on the slider 31 to displace it along the proximal and distal positions.

In a preferred but non-exclusive embodiment, the elastic counteracting means may include, respectively may consist in, a spiral spring 40 with predetermined diameter.

Depending on the configuration, the elastic counteracting means 40 may be thrust or recovery means.

In the case of thrust elastic counteracting means, the force thereof must be such to automatically return the shutter D from the open or closed position that it reaches when the slider 31 is in proximal position towards the other of the open or closed positions that it reaches when the slider 31 is in distal position.

In this case, depending on whether the position reached by the shutter D when the slider 31 is in proximal position is open or closed, the hinge 1 will be an opening hinge or a closing hinge or a door closer hinge.

In the case of elastic counteracting means, the force thereof—on the contrary—must be such not to automatically push the shutter D from the open or closed position that it reaches when the slider 31 is in proximal position towards the other of the open or closed positions that it reaches when the slider 31 is in distal position. In this case, the shutter D must be moved manually or however using external actuator means with respect to the hinge 1, for example a motor.

However, the force of the elastic recovery means must be such to return the slider 31 from the proximal position to the distal position.

In this case, depending on whether the position reached by the shutter D when the slider 31 is in proximal position is open or closed, the hinge 1 will be an opening or closing control hinge.

It is clear that the opening or closing hinge will also be used for opening or closing control purposes too, whereas the contrary is untrue.

It is clear that even though the attached figures illustrate a closing hinge 1, the latter may be a closing or opening hinge, just as it could be an opening or closing control without departing from the scope of protection of the attached claims.

In a preferred but non-exclusive embodiment, the working chamber 11 may include hydraulic damping means, indicated in their entirety with 50, for hydraulically damping the rotary movement of the shutter D.

It is clear that the hinge may be simply mechanical too, i.e. without hydraulic damping means, without departing from the scope of protection of the attached claims.

If present, the hydraulic damping means may be variously configured.

By way of non-limiting example, they may be obtained according to the disclosures outlined in the international patent application No. PCT/IB2015/050603. In this case, the hydraulic damping means may include a predetermined amount of oil entirely contained in the cylinder 31, so that the spiral spring 40 and the pin 20 are not submerged in an oil bath.

This enables simplifying the structure of the hinge 1 to the maximum and thus minimising the costs thereof. As a matter of fact, the entire hydraulics of the hinge will be entirely contained in the cylinder 31, the rest of the parts remaining drying and thus being easier to obtain and manage.

In a preferred but non-exclusive embodiment, the plunger element 30 may include a plate-shaped element 32 integrally coupled with the cylinder 31 to slide along the axis Y therewith. The plate-shaped element 32 and the cylinder 31 may preferably be mutually supported separate pieces.

Such plate-shaped element 32 may include an operative face 33 suitable to come into contact with the cam element 21 of the pin 20. The plate-shaped element 32 and in particular the operative face 33 thereof will thus act as cam followers.

In a preferred but non-exclusive embodiment, the cam element 21 of the pin 20 may have a first working surface 23 susceptible to come into contract with the operative face 33 of the cylinder 31 when it is in distal position and a second working surface 24 susceptible to come into contact with the operative face 33 of the cylinder 31 when it is in proximal position.

Advantageously, both the two working surfaces 23 and 24 and the operative face 33 may be substantially flat or slightly curved, and the mutual engagement may be for contact purposes.

The angle between the two working surfaces 23 and 24 may vary, and it will determine the opening angle of the shutter D.

The two working surfaces 23 and 24 may be substantially perpendicular to each other or form an obtuse angle.

The second working surface 24 of the cam element 21 may preferably include a damping portion 25 susceptible to interact with the cylinder 31 to slightly compress the spiral spring 40 from the maximum compression position should the user rotate the shutter D further, for example pushing it to open.

In this manner, the spiral spring 40 will damp the further rotary movement imparted by the user, thus preventing it from damaging the hinge and/or glass shutter.

The damping portion 25 may suitably be interposed between the second working surface 24 and a third surface 26 consecutive with respect thereto.

The hinge 1 may advantageously include braking means for braking the rotatable movement of the shutter D. Such braking means may include a braking shoe 60 acting by friction on the plate-shaped element 32. On the braking shoe there may preferably act an elastomeric element 61, for example a body made of Vulkollan®, suitable to deform in a differentiated manner upon the mutual interaction of the braking shoe 61 and the plate-shaped element 32.

In a preferred but non-exclusive embodiment, the plate-shaped element 32 may be configured to provide a differentiated friction during the sliding along the axis Y, so that the shutter D is correspondingly braked with differentiated force. To this end, the plate-shaped element 32 may include a first working zone 34' and a second working zone 34" designated to mutually interact with the braking shoe 61.

The first working zone 34' and the second working zone 34" may suitably be consecutive with respect to each other so as to selectively interact with the braking shoe 60.

Each of the working zones 34', 34" may include a respective first and second operative surface 35', 35", which may selectively come into contact with the braking shoe 61.

More in particular, the working zone 34' of the plate-shaped element 32 may have a greater thickness with respect to the working zone 34". Furthermore, the plate-shaped element 32 may have a flat wall 36 opposite to the operative surface 35', 35" at contact with the flat contact surfaces 13 of the working chamber 11, which may guide the plate-shaped element 32 during the sliding thereof along the axis 1.

In this manner, the two operative surfaces 35', 35" will deform the elastomeric body 61 in a differentiated fashion. In particular, the latter will deform more at the thicker working zone 34'. It is thus clear that at the working zone 34', the friction on the plate-shaped element 32 will be greater, and the braking force acting on the shutter D will be correspondingly greater.

It is clear that the cylinder may include working zones 34', 34" and the operative surfaces 35', 35" without departing from the scope of protection of the attached claims.

More generally, any side of the plunger element 30 may include working zones 34', 34" and the operative surfaces 35', 35" without departing from the scope of protection of the attached claims.

Irrespective of the presence or absence of the aforementioned braking means, the working chamber 11 may include a stop element 70, for example a pin, susceptible to interact with the plate-shaped element 32 to lock the sliding thereof at the proximal and distal positions of the plunger element 30.

This will enable correspondingly locking the rotation of the shutter D at the closing and opening positions.

To this end, the plate-shaped element 32 may have an elongated slot 37 into which the stop element 70 is inserted to abut against the opposite ends 38', 38" thereof, as illustrated in FIGS. 6B and 7B.

It is thus clear that the elongated slot 37 may define the stroke of the plunger element 30.

Figure 7C:
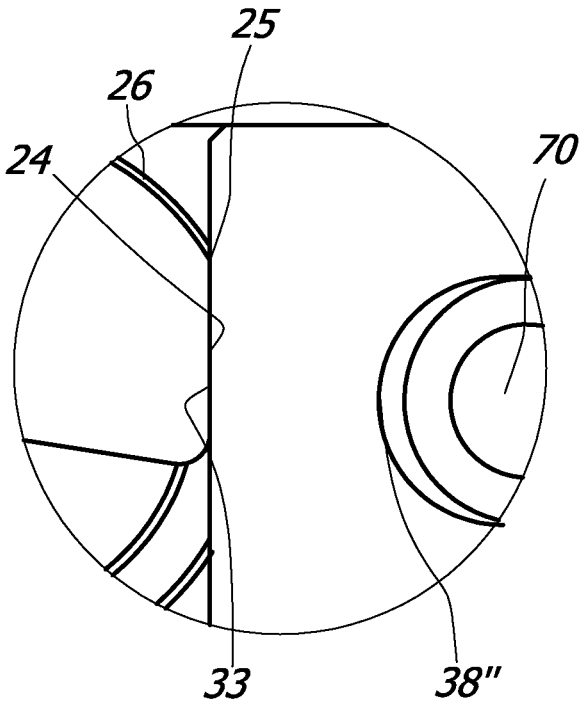
FIG. 7C is an enlarged cross-sectional view of some details of FIG. 7B.
Figure 7D:
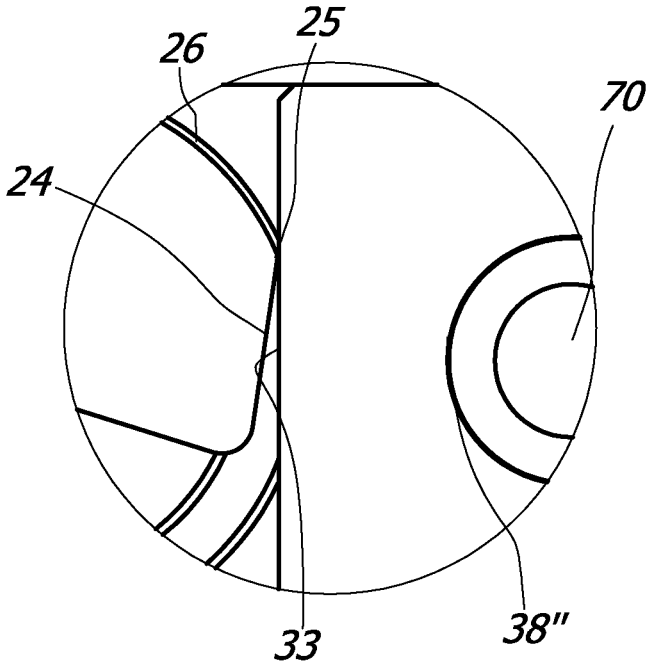
FIG. 7D is an enlarged cross-sectional view of some details of the second embodiment of the hinge 1 of FIG. 5 in the damping step.
Figure 8:
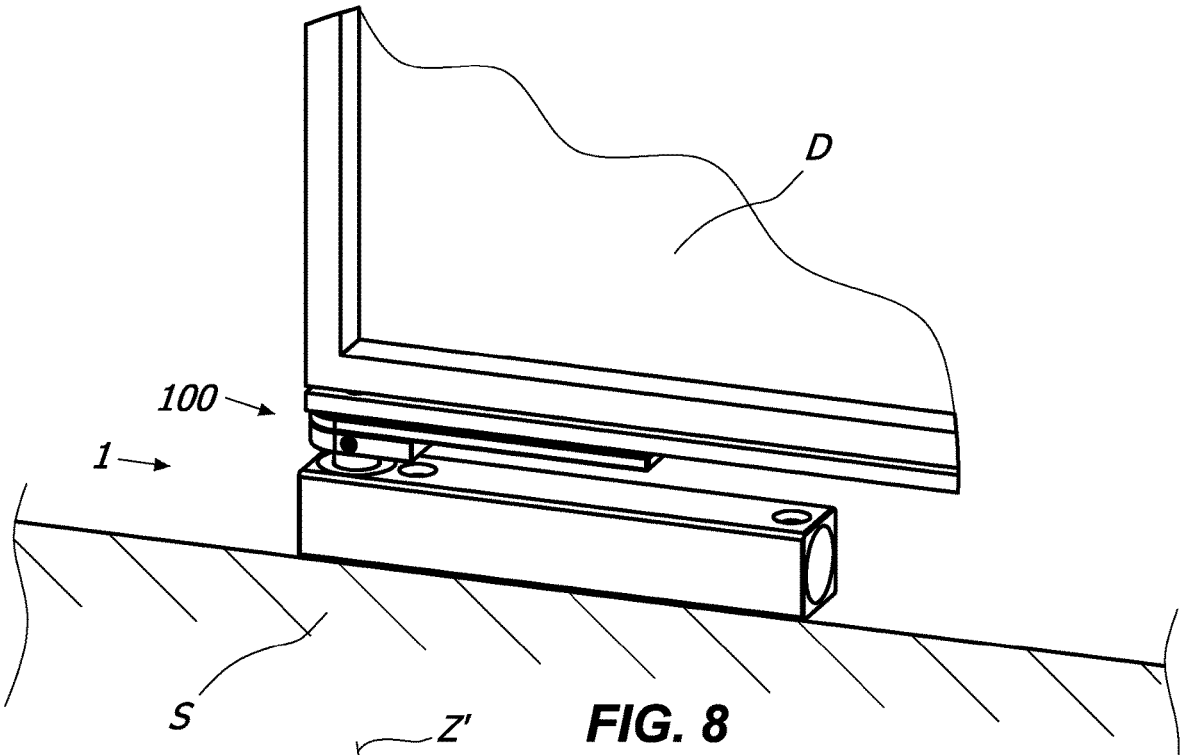
FIG. 8 is an axonometric view of a third embodiment of the hinge 1 mounted on a shutter D by means of a coupling device 100.
Figure 11A:
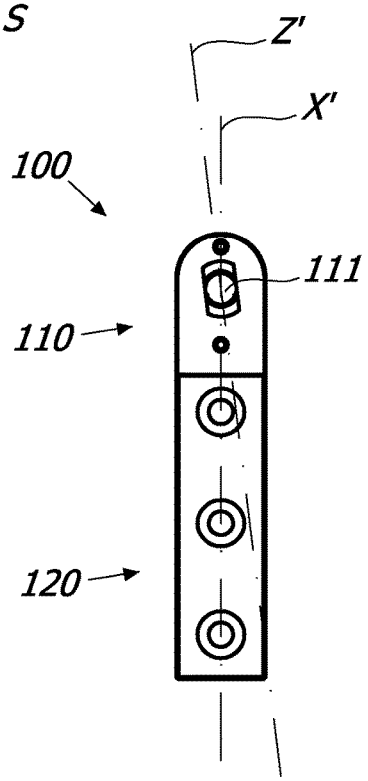
FIGS. 11A and 11B are bottom views of the coupling device 100 with the coupling portion 110 in the two directions.
Figure 11B:
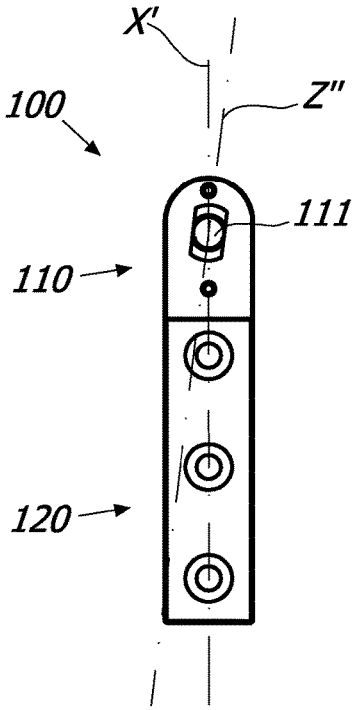
Figure 9:
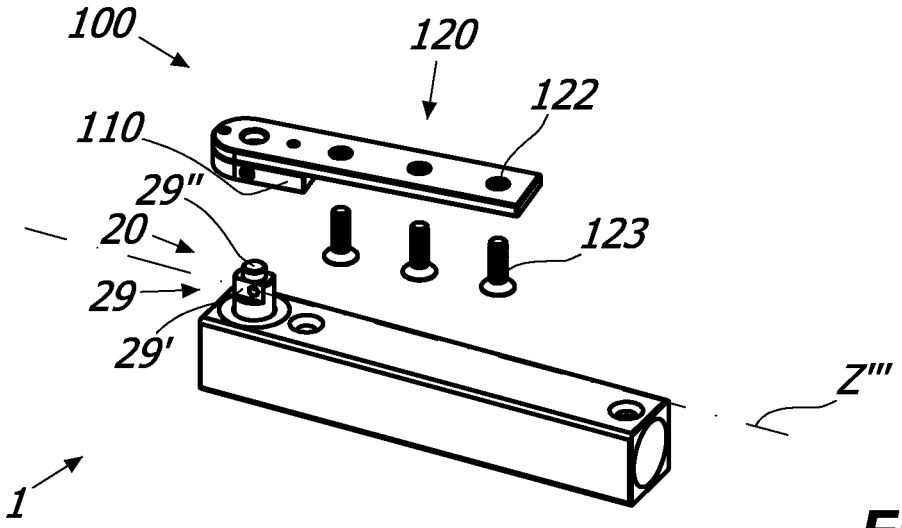
FIG. 9 is an exploded axonometric view of the hinge 1—coupling device 100 assembly.
Figure 10:
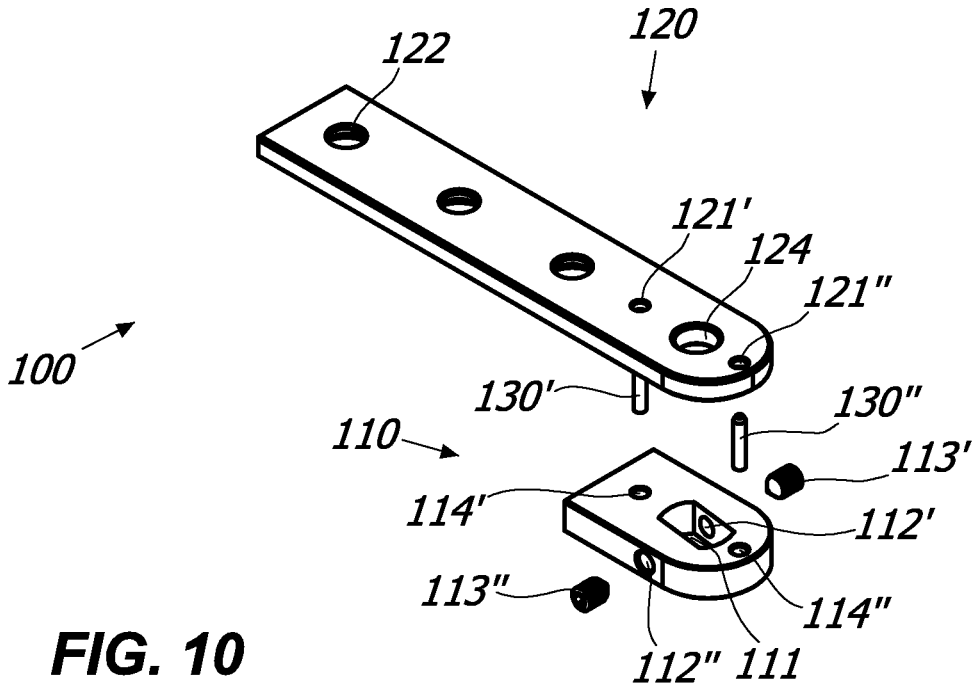
FIG. 10 is an exploded axonometric view of the coupling device 100.

Furthermore, in light of the above, the elongated slot 37 may be dimensioned so as to enable the damping due to the interaction of the operative face 33 and the portion 25 of the cam element 21, particularly illustrated in FIGS. 7C and 7D.

It is clear that the elongated slot 37 may be dimensioned so that the stop element 70 abuts even against just one end of the ends 38' or 38" thus remaining spaced apart from the other without departing from the scope of protection of the attached claims.

It is clear that the cylinder 31 may include an elongated slot 37 without departing from the scope of protection of the attached claims.

More generally, any part of the plunger element 30 may include an elongated slot 37 without departing from the scope of protection of the attached claims.

Irrespective of the presence or absence of braking means acting on the plunger element 30 and/or the aforementioned stop means, the pin 20 may comprise braking means for braking the rotatable movement of the shutter D.

Advantageously, such braking means may comprise a braking shoe 80 integrally rotating with the pin 20 to act against the inner surface 14 of the substantially cylindrical seat 11'. By way of non-limiting example, the braking shoe 80 may be a body made of elastomeric material, for example Vulkollan®.

It is clear that the cylindrical seat 11' may or may not include one or more elements for restricting the diameter thereof, such as for example bushings, bearings or the like, without departing from the scope of protection of the attached claims.

If the cylindrical seat 11' is vacant, i.e. without any element for restricting the diameter thereof, the inner surface 14 will be the surface of the cylindrical seat 11'. In other words, the braking shoe 80 will directly act against the hinge body 10.

In cases where, for example as illustrated in FIGS. 1 to 7B, the cylindrical seat 11' includes one or more elements for restricting the diameter thereof, such as a metal bushing 15 for example, the inner surface 14 will be the surface of the latter.

The braking shoe 80 may be inserted into a housing 27 passing through an upper operative portion 28 of the pin 20 facing the cylindrical seat 11'. The through housing 27 may define an axis Y', which may preferably be substantially perpendicular to the axis X.

Furthermore, within the housing 27 there may be provided an adjustment grub screw 81 directly or indirectly acting on the braking shoe 80, so as to adjust the braking force of the latter.

The adjustment grub screw 81 will adjust the projection of the braking shoe 80 from the end opening 27' of the housing 27. A greater projection may imply a greater braking force and vice versa.

To this end, at least part of the housing 27 and the adjustment grub screw 81 may be threaded and counter-threaded. In this manner, a user or an operator may access the end 82" of the adjustment grub screw 81 from outside the housing 27, for example using a screwdriver, to adjust the position thereof along the axis Y'. The end 82' of the adjustment grub screw 81 may correspondingly act as an abutment for the braking shoe 80.

In a preferred but non-exclusive embodiment, the hinge body 10 and the cylindrical seat 11' may include a through channel 16 susceptible to remain aligned with the through housing 27 when said at least one pin 20 is in a predetermined position, for example in the shutter-closed position D.

This will enable the user or the operator to access the end 82" of the adjustment grub screw 81 with the pin 20 inserted into the substantially cylindrical seat 11', i.e. actually with the hinge 1 mounted on the shutter D and anchored to the frame S.

The through channel 16 may advantageously be substantially parallel to the axis Y and perpendicular to the axis X.

It is clear that the housing 27 may also be blind, with the braking shoe 80 arranged in abutment against the bottom wall, without departing from the scope of protection of the attached claims. In this case, the braking shoe 80 will project from the housing 27 by a fixed and non-adjustable portion. Furthermore, the braking force will be fixed or adjusted depending on the configuration of the substantially cylindrical seat 11'.

Furthermore, it is clear that the adjustment grub screw 81 may also act indirectly on the braking shoe 80, for example by interposing one or more interface elements, without departing from the scope of protection of the attached claims.

It is also clear that the substantially cylindrical seat 11' may be variously configured without departing from the scope of protection of the attached claims. For example, the inner surface 14 thereof may have one or more reliefs or depressions or one or more steps, so as to provide a differentiated braking action during the rotation of the shutter D.

In this manner, the hinge 1 may be provided with a plurality of bushings 15 with different configuration to provide different braking actions depending on the utilised bushing.

The hinge 1 may be connected to the shutter D directly, as for example illustrated in FIGS. 2A to 7D, or through a coupling device 100.

In this case the hinge body may be anchored to the frame S, while the coupling device 100 may include a first plate-shaped element 110 and at least one second longitudinal plate-shaped element 120 anchorable to the shutter D, for example by means of screws 123 inserted through special seats 122.

In order to enable the operative connection between the hinge 1 and the coupling device 100, the pin 20 may include a coupling portion 29 projecting from the hinge body 10 having a lower shaped zone 29', for example parallelepiped-shaped and an upper substantially cylindrical zone 29", defining the axis X.

The first plate-shaped element 110 may include a through counter-shaped seat 111 mutually couplable with the shaped zone 29', while the second longitudinal plate-shaped element 120 may include a counter-shaped seat 124 mutually couplable with the substantially cylindrical zone 29".

Given that the second longitudinal plate-shaped element 120 may be superimposed with the first plate-shaped element 110, the latter may rotatably support the former.

In order to enable the coupling between the plate-shaped elements 110 and 120 and the integral rotation thereof, there may be provided one or more connection elements, for example a pair of pins 130', 130" passing through the through seats 114', 114" of the first plate-shaped element 110 and through the through seats 121', 121" of the second longitudinal plate-shaped element 120.

Advantageously, there may be provided means for the mutual locking of the coupling device 100 and the pin 20 once mutually coupled, for example grub screws 113', 113" inserted into special counter-threaded seats 112', 112". Such locking means may be of the removable type, so as to enable possible operations for the maintenance and/or replacement of the coupling device 100 and/or the hinge 1.

In a preferred but non-exclusive embodiment, the connection elements 130', 130" may be inserted into the relative seats 114', 114" and 121', 121" in a removable fashion.

The counter-shaped seat 111 may suitably have an elongated shape defining an axis Z', Z" substantially perpendicular to the axis X and angularly spaced with respect to the axis X' defined by the plate-shaped element 120. Once the shaped zone 29' of the pin 20 and the counter-shaped seat 111 of the plate-shaped element 110 are coupled, the axis Z', Z" may substantially coincide with axis Z'" defined by the shaped zone 29'.

Thus, when the hinge 1 is in a closed position, for example as illustrated in FIGS. 2B and 6B, the coupling device 100 will force the shutter D to close against the relative abutment surface.

As a matter of fact, in this position the axes Z', Z", Z'" will be substantially parallel to the axis Y, thus the axis X' of the plate-shaped element 120 may be angularly spaced by the latter by a predetermined angle, for example by 3°-8°.

The plate-shaped element will be suitably rotatable around the axis X', so that the user or operator may select the inclination of the shaped seat 111 or, equivalently, the direction of inclination of the axis Z' or Z" thereof.

This enables using the coupling device 100 on a shutter D opening to the right or to the left indistinguishably using a single plate-shaped element 110 and a single longitudinal plate-shaped element 120.

As a matter of fact, there are generally two types of state of the art coupling devices, one for shutters D opening to the right and one with shutters D opening to the left. Thanks to the characteristics outlined above, instead, a single coupling of plate-shaped elements 110, 120 enables using the same coupling device 100 for both types of shutters or doors.

To this end, in order to obtain an attachment for doors with opening to the right from one for doors with opening to the left or vice versa it is sufficient to remove the connection elements 130', 130" from the relative seats 114', 114" and 121', 121", rotate the plate-shaped element 110 around the axis X' and then re-insert the connection elements 130', 130" into the relative seats 114', 114" and 121', 121".

Alternatively, as outlined hereinafter, one can break the connection elements 130', 130" and insert new ones.

In any case, it is clear that in order to enable the rotation of the plate-shaped element 110, the latter and the plate-shaped element 120 must be mutually connected in a removable fashion. For example, screws, stop elements or equivalent removable connection elements may be provided for.

It is also clear that an operative connection between the plate-shaped element 120 and the pin 20 is not necessarily required. As a matter of fact, in light of the above, it is sufficient that the plate-shaped element 120 be integrally joined with the plate-shaped element 110 in a removable fashion.

Irrespectively of the above, and in particular irrespective of whether or not the plate-shaped element 110 can be rotated in order to obtain a single coupling device 100 that can be used on doors or shutters opening to the right or to the left, the one or more connection elements 130', 130" may be configured to break upon exceeding a predetermined threshold so as to allow the free mutual rotation between the plate-shaped element 110 and the longitudinal plate-shaped element 120.

This will enable maintaining the shutter D and the hinge 1 intact in case of inadvertent impact on the former.

As a matter of fact, conventional coupling devices in which the plate-shaped elements 110 and 120 are rigidly connected, the shutter D or the hinge 1 is usually damaged in case of inadvertent impact. The present invention enables averting this hazard.

It is clear that in this case the one or more connection elements 130', 130" do not have to be of the removable or through type. As a matter of fact, any integral connection between the plate-shaped elements 110 and 120 in a manner such to jointly rotate up to the breakage of one or more connection elements 130', 130" is sufficient in the latter case. For example, the latter may be a drop of any adhesive agent, suitable to hold the plate-shaped elements 110 and 120 joined together up to the predetermined load.

Furthermore, it is clear that the plate-shaped element 120 does not have to be necessarily inserted into the zone 29". As a matter of fact, it is sufficient that the plate-shaped element 110 rotatably supports the plate-shaped element 120. For example, the latter may include a cylindrical appendage that can be inserted into a counter-shaped seat of the plate-shaped element 110.

In light of the above, it is clear that the hinge according to the invention attains the pre-set objectives.

The hinge according to the invention is susceptible to numerous modifications and variants all falling within the inventive concept outlined in the attached claims. All details can be replaced by other technically equivalent elements, and the materials can be different depending on the technical needs, without departing from the scope of protection of the invention.

Even though the hinge has been described with reference to the attached figures, the reference numbers utilised in the description and in the claims are meant for improving the intelligibility of the invention and thus do not limit the claimed scope of protection in any manner whatsoever.

The invention claimed is:

1. A hinge for rotatable movement of a closing element between at least one closing position and at least one opening position, the closing element being adapted to be anchored to a stationary support structure, the hinge comprising:

a hinge body adapted to be anchored to the stationary support structure; and a pin adapted to be anchored to the closing element, said hinge body and said pin being coupled to each other, the pin having a cam defined thereon, the pin being rotatable with respect to the hinge body around a first longitudinal axis, wherein said hinge body includes a working chamber defining a second longitudinal axis, said working chamber having a plunger sliding therein, the plunger being caused to slide by the cam, along said second longitudinal axis, between a first end-stroke position, corresponding to one of the at least one closing position or the at least one opening position, and a second end-stroke position, corresponding to the other one of the at least one closing position or the at least one opening position, wherein said working chamber includes a stop element that interacts with said plunger to limit the sliding thereof at said first or said second end-stroke position, so as to correspondingly limit the rotation of the closing element at the at least one closing position or at least one opening position, wherein the plunger comprises a cylindrical portion and a plate-shaped portion that extends from the cylindrical portion toward the pin, wherein the plate-shaped portion abuts the cam so that the rotation of the pin causes the sliding of the plunger, and wherein said plate-shaped portion further includes an elongated slot having a pair of opposite ends, said stop element being inserted through said slot to abut against at least one of said opposite ends as soon as said plunger reaches at least one of said first or said second end stroke positions.

2. The hinge according to claim 1, wherein said elongated slot defines the stroke of said plunger, said stop element abutting against one of said opposite ends as soon as said plunger reaches one of said first or said second end stroke position and abutting against the other one of said opposite ends once said plunger reaches the other one of said first or said second end stroke position.

3. The hinge according to claim 1, further comprising a spring abutting the cylindrical portion of the plunger, the spring being movable between a minimum compression position and a maximum compression position to act on said plunger, wherein, when said spring is in said minimum compression position, the closing element is in one of the at least one closing position or the opening position, wherein, when said spring is in said maximum compression position, the closing element is in the other one of the at least one closing position or the at least one opening position, and wherein said spring, said stop element, and said elongated slot are arranged so that, when said spring is in the maximum compression position, said stop element engages one of the opposite ends of said elongated slot, and when said spring is in the minimum compression position, said stop element engages another one of the opposite ends of said elongated slot.

4. The hinge according to claim 3, wherein said plate-shaped portion is integrally coupled to said cylindrical portion.

5. The hinge according to claim 1, wherein a face of said plate-shaped portion abuts the cam, said cam including a first working surface that engages said face when the closing element is in said one of the at least one closing position or the at least one opening position and a second working surface that engages said face when the closing element is in said other one of the at least one closing position or the at least one opening position, said cam further including a damping portion configured to come into contact with said face upon any further rotation of said cam.

6. The hinge according to claim 1, wherein said pin defines said first longitudinal axis.

7. The hinge according to claim 4, wherein the rotation of the closing element during opening or closing is hydraulically damped.

8. The hinge according to the claim 7, further comprising a working liquid entirely contained in said cylindrical portion.

9. A hinge for rotatable movement of a closing element between at least one closing position and at least one opening position, the closing element being adapted to be anchored to a stationary support structure, the hinge comprising:

a hinge body adapted to be anchored to the stationary support structure; and a pin adapted to be anchored to the closing element, said hinge body and said pin being coupled to each other, the pin having a cam defined thereon, the pin being rotatable with respect to the hinge body around a first longitudinal axis, wherein said hinge body includes a working chamber defining a second longitudinal axis, said working chamber having a plunger sliding therein, the plunger being caused to slide by the cam, along said second longitudinal axis, between a first end-stroke position, corresponding to one of the at least one closing position or the at least one opening position, and a second end-stroke position, corresponding to the other one of the at least one closing position or the at least one opening position, wherein said working chamber includes a stop element that interacts with said plunger to limit the sliding thereof at said first or said second end-stroke position, so as to correspondingly limit the rotation of the closing element at the at least one closing position or at least one opening position, wherein the plunger comprises a cylindrical portion and a plate-shaped portion that extends from the cylindrical portion toward the pin, wherein the plate-shaped portion abuts the cam so that the rotation of the pin causes the sliding of the plunger, and wherein said plate-shaped portion further includes an elongated slot having a pair of opposite ends, said stop element being inserted through said slot to abut against at least one of said opposite ends as soon as said plunger reaches at least one of said first or said second end stroke positions; and a spring abutting the cylindrical portion of the plunger, the spring being movable between a minimum compression position and a maximum compression position to act on said plunger, wherein, when said spring is in said minimum compression position, the closing element is in one of the at least one closing position or the at least one opening position, wherein, when said spring is in said maximum compression position, the closing element is in the other one of the at least one closing position or the at least one opening position, wherein said spring, said stop element, and said elongated slot are arranged so that, when said spring is in the maximum compression position, said stop element engages one of the opposite ends of said elongated slot, and when said spring is in the minimum compression position, said stop element engages another one of the opposite ends of said elongated slot, wherein said plate-shaped portion is integrally coupled to said cylindrical portion, wherein the rotation of the closing element during opening or closing is hydraulically damped, and further comprising a working liquid entirely contained in said cylindrical portion.

* * * * *